United States Patent [19]

Jouret

[11] 4,186,550

[45] Feb. 5, 1980

[54] PROGRAMMER FOR ELECTRIC HOUSEHOLD APPLIANCES

[75] Inventor: Edouard Jouret, Bresso-Milano, Italy

[73] Assignee: Crouzet, Paris, France

[21] Appl. No.: 912,967

[22] Filed: Jun. 6, 1978

[30] Foreign Application Priority Data

Jun. 20, 1977 [FR] France ..... 77 19063

[51] Int. Cl.[2] ..... G04F 3/02; G04F 8/00

[52] U.S. Cl. ..... 58/21.13; 58/39.5; 307/141

[58] Field of Search ..... 307/132 R, 132 E, 132 EA, 307/132 M, 133; 236/46 R, 46 C, 46 D, 46 E, 46 F; 74/2, 3.54; 340/309.1; 58/21.13-22.9, 145 R, 152 R, 36.38, 38 FA, 38 B, 28 D

[56] References Cited

U.S. PATENT DOCUMENTS

| | | | |
|---|---|---|---|
| 2,751,155 | 6/1956 | Collat | 236/46 |
| 3,043,936 | 7/1962 | Page | 58/39.5 |
| 3,930,131 | 12/1975 | Nishina | 58/395 X |
| 4,041,325 | 8/1977 | Angott | 307/141 |

FOREIGN PATENT DOCUMENTS

| | | | |
|---|---|---|---|
| 721212 | 5/1942 | Fed. Rep. of Germany | 58/39.5 |
| 1760763 | 10/1970 | Fed. Rep. of Germany . | |
| 2098825 | 10/1972 | France . | |

*Primary Examiner*—Vit W. Miska
*Attorney, Agent, or Firm*—Holman & Stern

[57] ABSTRACT

Programmer for electric household appliances, comprising an assembly of programming cams driven in rotation by a reversing cam driven itself by a motor, a timing wheel driven in rotation by the reversing cam via a set of levers, a first cam of the cam assembly triggering off the rotating of the timing wheel and the simultaneous stopping of the cam assembly, a cam surface on the timing wheel triggering off again the rotating of the cam assembly and the stopping of the timing wheel after a timing the period of time of which is determined by a second cam of the cam assembly.

4 Claims, 2 Drawing Figures

PROGRAMMER FOR ELECTRIC HOUSEHOLD APPLIANCES

BACKGROUND OF THE INVENTION

The applicant's French Pat. No. 2 098 825 already relates to a programmer for electric household appliances, comprising a reversing cam, driven in continuous rotation by a motor and on which are pivotally mounted a first lever and a pawl, a fixed plate provided with an opening into which the first lever may penetrate, under the action of elastic means integral with the reversing cam and the pawl, to allow the pawl to engage with the teeth of a driving cam of an assembly of programming cams and thus rotate this cam assembly step by step, and a second lever which, via a timing wheel, may, for a determined period of time, prevent the first lever from penetrating in said opening and consequently prevent the rotation of said cam assembly.

In this device, the second lever is actuated by a third lever, itself actuated directly by the timing wheel. Apart from the fact that this timing wheel is driven by the motor, via a reduction gear, the duration of the stopping of the assembly of programming cams, or timing, can only be modified as a function of the profile of the inner periphery of the timing wheel. It is obvious that in such a case, the number of timings of different durations which may be obtained is fairly limited.

SUMMARY OF THE INVENTION

It is therefore an object of the present invention to increase the number of these timings. To this end, the invention relates to a programmer of the kind specified, wherein the timing wheel is arranged to be rotated by the reversing cam, the second lever is integral with a third lever engaging with a first programming cam of the cam assembly, the second and third levers are integral with a fourth lever arranged to engage with a cam surface provided on the timing wheel, the moment when the second lever prevents the rotation of the cam assembly and the reversing cam begins to drive the timing wheel being determined by the outer profile of said first programming cam, and the moment when this cam assembly is again rotated and the reversing cam ceases to drive the timing wheel being determined by the engagement of said fourth lever with said cam surface of the timing wheel.

In a preferred embodiment of the invention, the timing wheel is rotated by the reversing cam via a set of levers actuated, upon each revolution of the reversing cam, by a catch fixed to the reversing cam.

In this case, the timing wheel may be advantageously provided with outer peripheral teeth, the last timing wheel engaging lever of the set of levers being arranged to come into mesh with these outer teeth and drive the timing wheel, on each revolution of the reversing cam, in rotation over a determined arc of a circle.

The invention will now be described in detail with reference to the accompanying drawings.

DETAILED DESCRIPTION OF THE INVENTION

Figure 1:
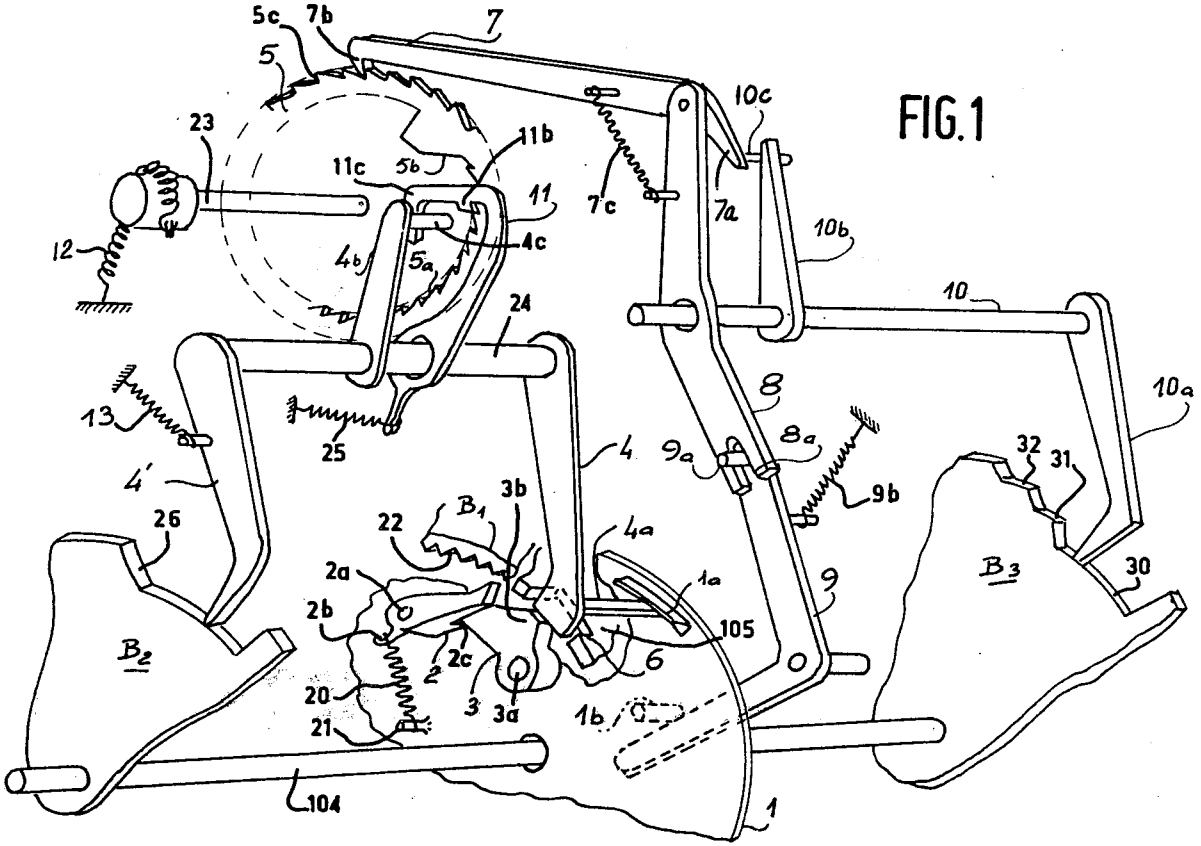
FIG. 1 is a perspective view of a device according to the invention.
Figure 2:
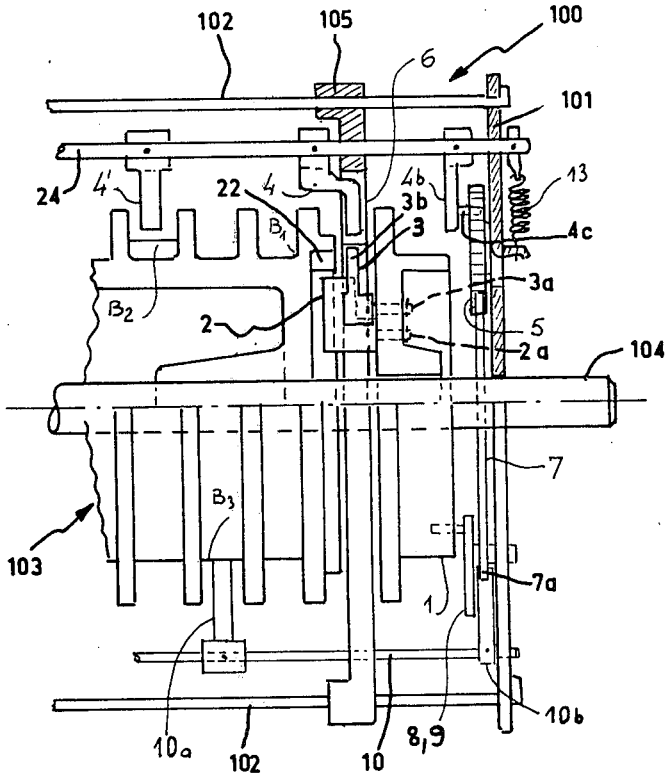
FIG. 2 is a partly longitudinal sectional view of the device of FIG. 1.

Referring now to the drawings, the programmer according to the invention is disposed in a casing 100 comprising two plates 101 connected by a series of columns 102. The programmer comprises an assembly of programming cams 103 mounted to rotate on a shaft 104 on which this assembly is for example moulded, and a reversing cam 1 driven in continuous rotation freely about the shaft 104 by a motor (not shown in the drawings). On the reversing cam 1 are mounted a lever 3 pivoting on a shaft 3*a* and a pawl 2 pivoting on a shaft 2*a*, the shafts 3*a* and 2*a* being fixed transversely with respect to the cam 1. The pawl 2 may pivot under the action of a biasing spring 20 fixed at one of its ends to a flange 2*b* of the pawl 2 and, at its other end, to a catch 21 projecting on the cam 1. The pawl 2 has a support surface 2*c* for engaging with the lever 3. Perpendicularly to the shaft 104 of the programmer and at right angle to the lever 3 there is disposed in the casing 100 a plate 105 fixed to the columns 102 and in which an opening 6 is provided. When, during the rotation of the reversing cam 1, a flange 3*b* of the lever 3 is located opposite the opening 6, said lever may penetrate in said opening and allow the pawl 2 to pivot under the action of its spring 20. On the other hand, when the flange 3*b* of the lever 3 comes into abutment against the plate 105, preventing said former from pivoting, the pawl 2 is also prevented from pivoting by the lever 3 in abutment on the surface 2*c* of the pawl 2.

The assembly of programming cams 103 comprises a drive cam $B_1$ disposed substantially at right angle to the pawl 2 and provided with inner peripheral teeth 22 engageable by the pawl 2. Consequently, upon each passage of the lever 3 in front of the opening 6 of the plate 105, the pawl 2 meshes with the teeth 22 of the drive cam $B_1$, the assembly of programming cams 103 thus being able to be driven in rotation, step by step, by the cam 1.

This step by step drive may be stopped by obturating the opening 6 by a lever 4 against which the flange 3*b* of the lever 3 abuts upon each rotation of the cam 1 and which, by preventing it from pivoting, consequently prevents the engagement of the pawl 2 and the drive cam $B_1$.

The present invention precisely provides the possibility of holding this lever 4 in the opening 6, i.e. of stopping this step by step drive during programmed timings of different durations and in a sufficient number.

The programmer of the invention comprises a timing wheel 5 arranged to be rotated about a shaft 23 by the reversing cam 1 itself, and against the action of a biasing spring 12. This timing wheel 5 is provided with outer peripheral teeth 5*c* and may be driven in rotation by a set of levers 7, 8 and 9 actuated upon each revolution of the reversing cam 1, by a catch 1*b* projecting on the cam 1. The first lever 9 of this set of levers is pivotally mounted on a shaft 9*b* mounted to pivot in the casing 1 under the action of the catch 1*b* and against the action of a biasing spring 9*b*; the lever 8 is mounted to pivot freely on a shaft 10 also pivotally mounted in the casing 1 under the action of a catch 9*a*, projecting on the end of the lever 9 opposite the catch 1*b*, slidable in a notch 8*a* made at the corresponding end of the lever 8; and the last lever 7 is mounted to pivot at one of its ends 7*a* on the end of the lever 8 opposite the notch 8*a*. The other end 7*b* of the lever 7 is arranged in the form of a nose in order to be able to engage with the teeth 5c of the timing wheel 7 and thus drive it in rotation, under the combined action of the lever 8 and a biasing spring 7c integral with the two levers 8 and 7.

The timing wheel 5 also comprises inner peripheral teeth 5a on which a retaining pawl 11, by a slightly offset catch 11b, may mesh to prevent the wheel 5, during its drive by lever 7, from returning to its starting position under the action of the spring 12. A cam surface 5b is also made on the inner periphery of the timing wheel 5 in order to determine the end of a timing, as is described hereinafter.

The lever 4 is fixed to a shaft 24 pivotally mounted in the plates 101 of the casing 100. Two other levers 4' and 4b are also fixed to the shaft 24. The lever 4', which is subjected to the action of a biasing spring 13, engages with the outer profile of a programming cam $B_2$ of the cam assembly 103. The cam $B_2$ comprises a notch 26, in which the lever 4' may drop under the action of the spring 13, this causing the shaft 24 to rotate and consequently the lever 4 to pivot, the end of which obturates the opening 6 of the plate 105, thus triggering off the beginning of a timing.

The retaining pawl 11, which may pivot freely about the shaft 24, is subjected to the action of a biasing spring 25 and comprises a finger 11c, the usefulness of which will appear hereinafter.

The lever 4b possesses at its end a catch 4c, disposed parallel to the shaft 24, whose function is two-fold. It is firstly intended to engage with the finger 11c of the pawl 11 to prevent its catch 11b from being in mesh with the inner teeth 5a of the timing wheel, against the action of its biasing spring 25, during the rotation of the cam assembly 103. It is also intended to engage with the cam surface 5b of the wheel 5 which causes the lever 4b, and therefore the lever 4, to pivot, against the action of the spring 13, in order to clear the opening 6 and thus stop the timing.

Before the means used for varying this timing are described, it is preferable to deal with the functioning of the elements described hereinbefore.

The assembly of programming cams 103 being in rotation, there will be a moment when the notch 26 of the cam $B_2$ arrives beneath lever 4'. The latter, under the action of spring 13, drops in this notch 26, this causing the lever 4b and lever 4 to pivot, which latter obturates the opening 6, thus causing the stopping of the cam assembly 103. The lever 4b having pivoted, the pawl 11, under the action of the spring 25, meshes with the teeth 5a of the timing wheel 5 which, under the action of the cam 1, which continues to rotate, and of the levers 9, 8 and 7, is driven in rotation.

The timing starts, and it continues until the cam surface 5b again causes the lever 4b to pivot in the other direction, against the action of the spring 13, via its catch 4c, said latter simultaneously disengaging the pawl 11 and the teeth 5a, against the action of its spring 25. At the end of the timing, the wheel 5, under the action of its biasing spring 12, returns to its starting position. The pivoting of the lever 4b causes the lever 4' and lever 4 to pivot, the latter again clearing the opening 6. At this moment, the timing wheel ceases to be driven in rotation and the pawl 2 begins to drive the cam assembly 103 in step by step rotation again, via the drive cam $B_1$. This is the end of the timing, and the lever 4' is located out of the notch 26 of the cam $B_2$.

The duration of a timing is therefore determined by the number of revolutions, each being effected at the same time, which the reversing cam 1 must effect to bring the cam surface 5b of the timing wheel 5 in engagement with the catch 4c of the lever 4b. This number of revolutions is in fact a function of the arc of rotation through which the wheel 5 passes under the action of the lever 7 at each rotation of the cam 1. It is therefore the length of this arc of rotation which the present invention aims to have varied in programmed manner. This arc is itself a function of the time during which, at each rotation of the cam 1, the nose 7b of the lever 7 remains in mesh with the toothing 5c of the wheel 5.

The cam assembly 103 of the invention comprises a second programming cam $B_3$, the outer profile of which comprises several levels 30, 31, 32, . . . provided to define a plurality of timings. On shaft 10 are fixed a lever 10a engaging with the profile of the cam $B_3$, and a lever 10b, at the end of which is fixed a rod 10c extending parallel to the shaft 10 and intended to serve as stop for the end 7a of the lever 7.

Thus, according to the level of the profile of the cam $B_3$ with which the lever 10a engages at the beginning of each timing, the lever 10b occupies a determined angular position on the shaft 10, which determines the instant when the lever 7, during its drive of the wheel 5, comes into abutment on this rod 7a and is obliged to pivot on the lever 8 to be disengaged from the teeth 5c of the wheel 5. It will be readily appreciated that the number of timings of different durations which may be obtained with the device of the invention is equal to the number of levels made on the cam $B_3$. The number may be relatively high, which was the purpose of the invention.

Finally, a circular projection 1a is disposed on one of the faces of the cam 1 to engage with a catch 4a projecting transversely on the end of the lever 4, to complete the action of the biasing spring 13 and lock the lever 4 in the opening 6 during each timing.

The invention makes it possible to produce programmer particularly for automatic washing machines, of which the program comprises stop times which are very long with respect to the period of normal passage of the steps of the driving cam.

What we claim is:

1. A programmer for electric household appliances comprising a reversing cam, a motor for continuously rotating said reversing cam, a programming cam assembly comprising a toothed driving cam and at least one programming cam driven by said driving cam, engageable and disengageable driving connection means between said reversing cam and said driving cam, a timing wheel, means forming a driving connection between said reversing cam and said timing wheel and control means for controlling engagement and disengagement of said driving connection means, said driving connection means including a first lever and a pawl each povotally mounted on said reversing cam, said pawl having a first position in which it drivingly engages the teeth of said driving cam and said first lever being engageable with said pawl to displace said pawl from said first position, said control means including a fixed plate formed with an opening, said first lever having a part received in said opening when said pawl is in driving engagement with the teeth of said driving cam, a second lever having a portion movable into said opening to displace said part of said first lever from said opening and cause said first lever to move said pawl out of engagement with the teeth of said driving cam, means for moving said portion of said second lever into said opening comprising a third lever moveable with said second lever and engaging said programming cam, said programming cam having a profile portion effective to move said third lever causing said portion of said second lever to move into said opening and means for displacing said portion of said second lever from said opening to cause said pawl to re-engage the teeth of said driving cam comprising a fourth lever moveable with said second and third levers and a cam surface on said timing wheel for engaging and moving said fourth lever to displace said portion of said second lever from said opening.

2. A programmer as claimed in claim 1, further including a set of levers forming said driving connection through which said timing wheel is driven in rotation by said reversing cam, and a catch fixed to said reversing cam for actuating said set of levers upon each revolution of said reversing cam.

3. A programmer as claimed in claim 2, wherein said timing wheel is provided with outer peripheral teeth said set of levers including a final lever arranged to mesh with said outer teeth for driving said timing wheel, upon each revolution of said reversing cam, through a predetermined arc of circle.

4. A programmer as claimed in claim 3, further including a fifth lever and a sixth lever movable with the fifth lever, wherein said final lever of said set of levers is mounted for pivoting on a preceding lever of said set of levers and is arranged for abuting against said firth lever to be disengaged from said outer teeth of said timing wheel, the position of said fifth lever being determined by said sixth lever which engages with a second programming cam of said cam assembly having an outer profile with several levels.

* * * * *